US005683342A

United States Patent [19]

McNair

[11] Patent Number: 5,683,342

[45] Date of Patent: Nov. 4, 1997

[54] OIL CLEANING ASSEMBLIES FOR ENGINES

[75] Inventor: James McNair, Bristol, England

[73] Assignee: The Glacier Metal Company Limited, England

[21] Appl. No.: 433,405

[22] PCT Filed: Jan. 20, 1994

[86] PCT No.: PCT/GB94/00107

§ 371 Date: May 18, 1995

§ 102(e) Date: May 18, 1995

[87] PCT Pub. No.: WO94/16822

PCT Pub. Date: Aug. 4, 1994

[30] Foreign Application Priority Data

Jan. 23, 1993 [GB] United Kingdom ..... 9301340

[51] Int. Cl.[6] ..... B04B 9/06

[52] U.S. Cl. ..... 494/49; 494/901

[58] Field of Search ..... 494/70, 68, 67, 494/43, 73, 49, 901, 36; 210/360.1, 380.1, 512.1

[56] References Cited

U.S. PATENT DOCUMENTS

| | | | |
|---|---|---|---|
| 1,122,457 | 12/1914 | Wright | 494/43 |
| 1,760,071 | 5/1930 | Koepke | 494/67 |
| 4,230,581 | 10/1980 | Beazley | 494/901 |
| 4,288,030 | 9/1981 | Beazley et al. | 494/901 |
| 4,492,631 | 1/1985 | Martin | 494/901 |
| 4,498,898 | 2/1985 | Haggett | 494/49 |
| 4,557,831 | 12/1985 | Lindsay et al. | 494/49 |
| 4,861,329 | 8/1989 | Borgstrom et al. | 494/73 |
| 5,096,581 | 3/1992 | Purvey | 494/49 |

FOREIGN PATENT DOCUMENTS

| | | | |
|---|---|---|---|
| 2837 | 12/1889 | United Kingdom | 494/73 |
| 2160796 | 1/1986 | United Kingdom . | |

*Primary Examiner*—Tony G. Soohoo

*Attorney, Agent, or Firm*—Nixon & Vanderhye P.C.

[57] ABSTRACT

In a centrifugal separator of the kind used for liquids such as oil, a rotor contains a separation cone interposed between the main volume of the rotor and the outlet nozzles which, in use, cause the rotor to spin. This cone includes a plurality of radially extending ribs.

3 Claims, 1 Drawing Sheet

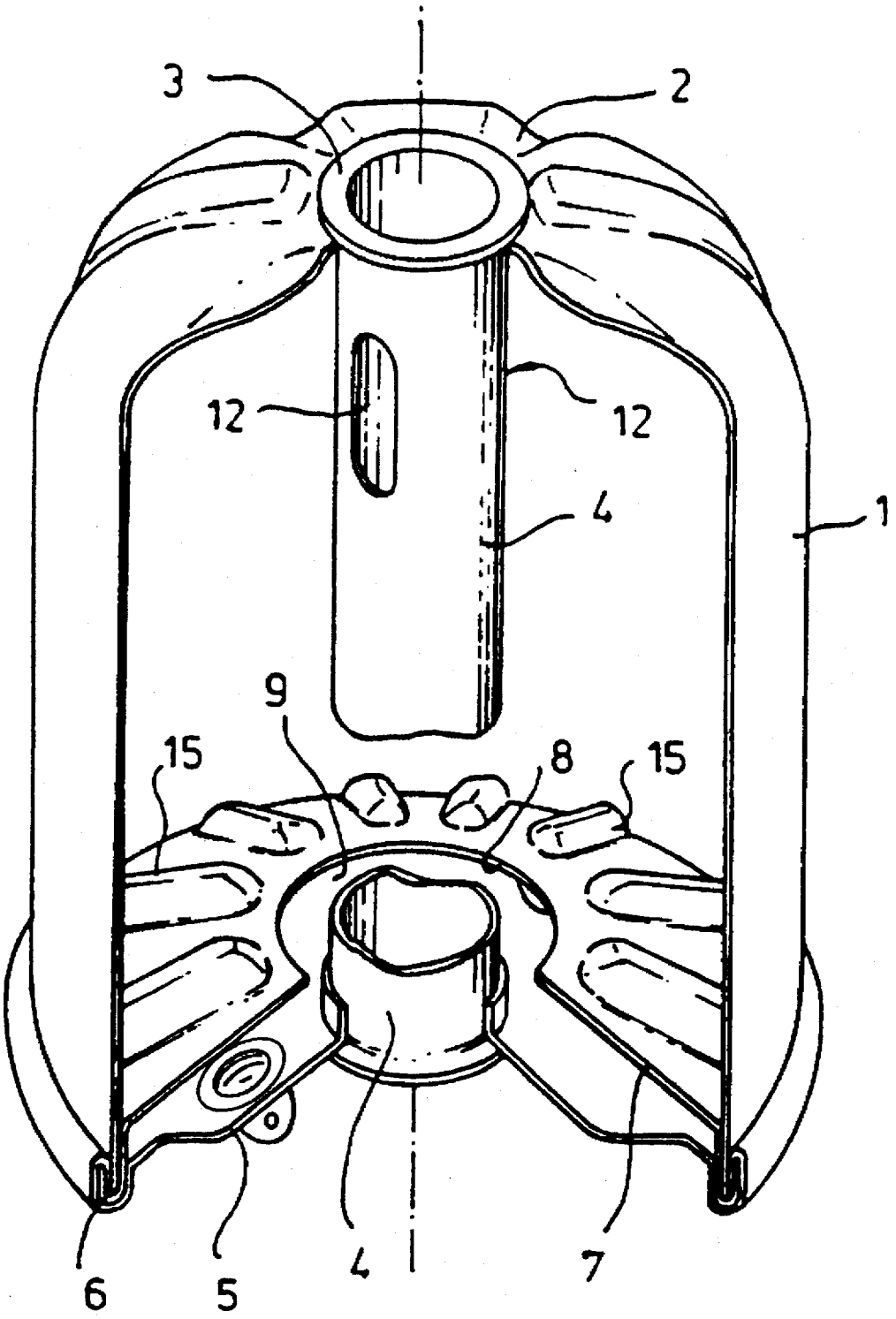
3
2
12
12
4
1
9
15
8
15
6
5
4
7

OIL CLEANING ASSEMBLIES FOR ENGINES

TECHNICAL FIELD

This invention concerns lubricating oil cleaning assemblies for engines particularly internal combustion engines. Servicing engines and particularly car and truck engines is a labour-intensive operation which needs to be done rapidly so disposable oil-cleaning units need to be used wherever possible.

BACKGROUND

Conventionally, oil is filtered by interposing a "full flow" filter medium, typically paper, in the path of all of the oil flow delivered by the engine lubricating oil pump. Centrifugal separators, which are now in more common use than was previously the case, act essentially as by-pass oil cleaning devices, because they usually treat only part of the oil flow from the pump, typically up to about 10% of the total, prior to returning the treated oil direct to the sump.

Full flow filter elements designed to remove fine contaminants through the use of very fine filter media pores do tend to become clogged and their performance deteriorates with time. However, centrifugal separators do not utilise filter media and their performance remains virtually constant with time.

Although disposable centrifugal separators have been proposed, they have been of the spin-on type which depends from a mounting in the same way as disposable full flow filters. However, because centrifugal separators normally drain by gravity to the sump, a second pipe connection at their lower end has had to be provided which is a serious drawback.

In some preferred arrangements, the centrifugal separator itself is not disposable but the rotor is. This is because a disposable rotor should preferably be non-disassemblable and tamper-proof, which helps prevent ingress of dirt during maintenance.

One example of a centrifugal separator is found in patent No GB 2,160,796B in which there is provided an oil cleaning assembly for an engine, comprising a centrifugal separator unit and a filter unit which each have a casing releasably connected at one end to a mounting means in such a way that the casings may be independently removed from the mounting means, and which both have an oil inlet and an oil outlet at said end, the centrifugal separator unit being arranged to extend substantially vertically upwards from the mounting means and being of the kind in which oil to be treated is introduced into the interior of a substantially closed rotor under pressure and leaves the rotor through discharge means, typically a pair of nozzles such that the reaction force spins the rotor about a substantially vertical axis, and the mounting means providing a common oil supply passage for the separator unit and filter unit whereby oil flows in parallel through both the separator unit and the filter unit at all times when oil flows through said passage, a drain passage for draining oil from the separator unit to the engine sump and a discharge passage from the filter unit for supplying oil to the engine lubrication system. The rotor is driven only by the oil flow through the discharge means and not by any external drive means. This part of the assembly is thus quite conventional in its operation.

In the arrangement just described, the rotor base immediately above the discharge means usually includes a separation cone in the form of a downwardly facing frustum of a cone whose upper rim or apex is spaced from a central support tube for the rotor and whose periphery or base is attached to the inside of the rotor wall, at or adjacent the Base thereof. The separation cone thus partially divides the rotor into two separate, but communicating chambers, one of which is relatively large and constitutes the upper part of the rotor which receives the detritus from the oil. The other, or lower chamber is relatively small and from which the oil escapes via the nozzles. Fluid escapes from the upper chamber by flowing firstly down the rotor wall and then up the surface of the separation cone, to the annular clearance space between the apex of the cone and the central support tube. It thereafter passes into the lower chamber, prior to escaping through via the nozzles.

The separation cone is believed to be advantageous in causing a change of direction of oil flow inwardly towards the central tube before it can escape via the nozzles. This results in a serpentine flow path which gives more opportunity for detritus to be trapped on the inner wall of the rotor. However, it has now been discovered that improved separation of detritus can be accomplished by a modified separation cone construction.

SUMMARY OF THE INVENTION

According to the present invention, a centrifugal separator of the kind described includes a separation cone provided with a plurality of radially extending ribs. The number of ribs is not critical, although if too many are used, their effect is reduced. A preferred number of ribs would be in the range 5 to 10, depending on the size (diameter) of the cone.

It has been found that relatively shallow ribs, for example 2–3 mm deep and 5–10 mm wide are satisfactory.

Whilst the exact shape of the ribs does not appear to be critical, it is preferred that they are located towards the inner edge of the cone, where the oil velocity is lower, rather than at the radially outermost edge of the cone, where it is affixed to the rotor wall and/or base.

BRIEF DESCRIPTION OF THE DRAWING

In order that the invention be better understood a preferred embodiment of it will now be described by way of example with reference to the accompanying drawings in which the sole FIGURE is a perspective view partly in section through a rotor according to the invention.

DETAILED DESCRIPTION OF THE DRAWING

In the FIGURE the rotor comprises a generally cylindrical casing 1, the upper part 2 of which is secured to a cylindrical bush 3. The latter serves to locate and retain a central tube 4. The lower end of the rotor has a base plate 5 attached at its outer margin to the lower rim of the casing 1 by an annular crimp or fold 6. A pair of conventional nozzles 10 are mounted in the plate 5. The inner margin of the base plate 5 is fixed to the lower end of the central tube 4 by rolling over the end region of the latter so as to provide further support. Not shown in the FIGURE is a further cylindrical bush which is provided at the foot of the tube 4.

Also extending radially inwardly from the annular crimp 6 is a plate 7 in the form of a frustum of a cone, the upper radially inner rim 8 of which terminates so as to define an annular gap or exit passageway 9 between it and the central tube 4. The lower, radially outer margin of the plate 7 is attached to the lower end of the casing 1 above and substantially adjacent the plate 5. Adjacent the upper end of the tube 4 there are two diametrically opposed oil inlet ports 12, only one of which can be seen in the FIGURE.

It will be appreciated that the plate 7 is the separation cone for the rotor. In this case, it includes a plurality of radially extending ribs 15, according to the invention. (For reasons of clarity, the lower portion of the central tube has been cut away so that the shape/disposition of these ribs 15 may be better seen.) In this instance, some ten ribs were provided, although in a smaller size of rotor, it would be preferably to have a smaller number, say five ribs in all, for the reason given earlier. The ribs were 2.5 mm deep and about 7 mm wide, with rounded side edges. The radially outward ends of the ribs were spaced from the casing 1; the inner ends were close to the margin 9, although for reasons of clarity the spacing is slightly exaggerated in the FIGURE.

I claim:

1. In a centrifugal separator for liquid media which includes a casing, a base plate connected to a lower end of the casing with discharge nozzles mounted in said base plate, a central tube extending through the base plate, upwardly into engagement with an upper part of the casing, and a separation cone in the form of a downwardly facing frustum of a cone, an upper radially inner rim of said separation cone being spaced from said central tube to thereby define an exit passageway between the separation cone and the tube, and a lower radially outer margin of said separation cone being attached to a lower rim of the casing throughout the circumference thereof and substantially adjacent the base plate so as to define an upward and inward flow path over the separation cone from said casing towards said upper rim, the improvement wherein said separation cone is provided with a plurality of generally radially directed and upwardly projecting ribs.

2. A centrifugal separator according to claim 1 wherein said separation cone is provided with from 5 to 10 radially directed ribs.

3. A centrifugal separator according to claim 1 wherein said ribs extend only part way down said cone, from said upper rim.

* * * * *